US005951944A

United States Patent [19]

Motomura et al.

[11] Patent Number: 5,951,944

[45] Date of Patent: Sep. 14, 1999

[54] LOWLY DECARBURIZABLE SPRING STEEL

[75] Inventors: Hiroharu Motomura, Minamikawachi-machi; Katsuyuki Uchibori, Chuo-ku, both of Japan

[73] Assignee: Mitsubishi Steel Mfg. Co., Ltd., Tokyo, Japan

[21] Appl. No.: 09/055,799

[22] Filed: Apr. 6, 1998

Related U.S. Application Data

[63] Continuation-in-part of application No. 08/883,211, Jun. 26, 1997, abandoned, which is a continuation-in-part of application No. 08/568,182, Dec. 6, 1995, abandoned.

[30] Foreign Application Priority Data

Dec. 21, 1994 [JP] Japan ..... 6-318469

[51] Int. Cl.[6] ..... C22C 38/08; C22C 38/16

[52] U.S. Cl. ..... 420/119; 420/89; 420/90; 420/91; 420/92; 148/909

[58] Field of Search ..... 420/119, 89, 90, 420/91, 92, 93, 112; 148/908

[56] References Cited

U.S. PATENT DOCUMENTS

| | | | |
|---|---|---|---|
| 5,118,469 | 6/1992 | Abe et al. | 148/908 |
| 5,286,312 | 2/1994 | Shionotsusa et al. | 148/908 |
| 5,415,711 | 5/1995 | Takagi et al. | 148/908 |

*Primary Examiner*—Deborah Yee
*Attorney, Agent, or Firm*—Flynn, Thiel, Boutell & Tanis, P.C.

[57] ABSTRACT

A lowly decarburizable spring steel comprises, on a weight basis, 0.51 to 0.70% of C, 0.15 to 2.50% of Si, 0.40 to 1.20% of Mn, 0.005 to 0.100% of Al, 0.005 to 0.050% of S, at least one of 0.05 to 0.30% of Ni and 0.05 to 1.00% of Cu and, optionally, at least one of 0.20 to 1.50% of Cr, 0.05 to 1.00% of Mo, 0.01 to 0.50% of V, 0.010 to 0.300% of Nb and 0.0005 to 0.0050% of B, and the balance consisting of Fe and unavoidable impurities. The spring steel can be remarkably lowered in decarburizability during hot working and heat treatment thereof without need of any decarburization-proofing agents and any specific heat treatment equipment. Accordingly, it has a very excellent effect in that the decarburization thereof can be remarkably decreased with a low cost when it is applied to a coil spring, a flat spring or a torsion bar.

17 Claims, No Drawings

LOWLY DECARBURIZABLE SPRING STEEL

This is a continuation-in-part of U.S. Ser. No. 08/883,211, filed Jun. 26, 1997, now abandoned which is a continuation-in-part of U.S. Ser. No. 08/568,182, filed Dec. 6, 1995, now abandoned.

BACKGROUND OF THE INVENTION

1. Field of the Invention

The present invention relates to a spring steel for use in the production of springs, and more particularly to a spring steel having a remarkably low decarburizability during the hot rolling thereof (rolling of a bar stock or a plate material) as well as during heating and heat treatment thereof for hot forming and working thereof.

2. Description of the Prior Art

In general, flat springs, coil springs and torsion bars are produced through quench hardening and heat treatment such as tempering of a hot-rolled material. If the surface of a steel material is decarburized in the foregoing production process, the fatigue strength thereof is notably lowered to present a problem that the resulting product cannot exhibit the properties of a spring.

Accordingly, a method wherein a coating layer of a decarburization-proofing agent is formed on the surface of a steel material, followed by heat treatment thereof, a method wherein a steel material is heat-treated in an atmosphere, and the like have heretofore been adopted as decarburization-preventive technologies.

A method wherein a variety of element(s) is added to a steel material to lower the decarburizability thereof has also been adopted. For example, Japanese Patent Laid-Open No. 170,542/1986 discloses Cu and Ni as such additive elements, Japanese Patent Laid-Open No. 274,058/1987 discloses Sb as such an additive element, and Japanese Patent Laid Open No. 223,148/1988 discloses Pb, Bi and Sn as such additive elements.

The conventional decarburization-preventive technologies involve the following problems, because of which an increase in cost cannot be avoided.

a. The method wherein a coating layer of a decarburization-proofing agent is formed on the surface of a steel material is time-consuming because of the time for application and it requires equipment therefor.

b. The method wherein a steel material is heat-treated in an atmosphere is costly in connection with the formation of an atmospheric gas and it involves the use of an atmospheric heating furnace, which is expensive as compared with a common furnace.

SUMMARY OF THE INVENTION

According to the present invention, the combination and amounts of Ni, Cu and S as trace components as are usually contained in a spring steel in the production thereof are controlled to lower the decarburizability thereof, whereby a spring steel can be provided inexpensively as compared with those produced according to conventional methods.

The present invention provides a lowly decarburizable spring steel comprising, on a weight basis, 0.51 to 0.70% of C, 0.15 to 2.50% of Si, 0.40 to 1.20% of Mn, 0.005 to 0.100% of Al, 0.005 to 0.050% of S, at least one of 0.05 to 0.30% of Ni and 0.05 to 1.00% of Cu and, optionally, at least one of 0.20 to 1.50% of Cr, 0.05 to 1.00% of Mo, 0.01 to 0.50% of V, 0.010 to 0.300% of Nb and 0.0005 to 0.0050% of B, and the balance consisting of Fe and unavoidable impurities.

DETAILED DESCRIPTION OF THE PREFERRED EMBODIMENTS

The reasons for specifying the components and the contents thereof are as follows.

C: C is an element which is effective in enhancing the strength of steel. When the C content is lower than 0.51%, the high strength desirable as a spring steel cannot be secured. When it exceeds 0.70%, the resulting spring becomes too brittle. Thus, it is set in the range of 0.51 to 0.70%.

Si: Si is an element which can function as a deoxidizer during the melt production of steel and is effective in improving the strength of steel through the solid solution thereof in ferrite. When the Si content is lower than 0.15%, a sufficient deoxidation function of Si and the strength required of a spring cannot be secured. When it exceeds 2.50%, the toughness of steel deteriorates. Thus, it is set in the range of 0.15 to 2.50%.

Mn: Mn is an element which is effective in improving the hardenability of steel, for the purpose of which the Mn content must be at least 0.40%. When it exceeds 1.20%, however, the toughness of steel deteriorates. Thus, it is set in the range of 0.40 to 1.20%.

Al: Al is an element which is a deoxidizer for steel and is required in order to control the size of austenite crystal grains. When the Al content is lower than 0.005%, the crystal grains cannot be made fine. On the other hand, when it exceeds 0.100%, the castability of molten steel at the time of solidification thereof is liable to lower. Thus, it is set in the range of 0.005 to 0.100%.

S, Ni, Cu: S, Ni and Cu are concentrated under a scale layer during the course of heating the spring steel in a heating furnace to prevent C from escaping through the surface of the steel, and hence are elements which are effective in lowering the decarburizability thereof. Further, three kinds of combinations of elements among these three elements, i.e., S+Ni, S+Cu, and S+Ni+Cu, when added, are especially effective in lowering the decarburizability of steel. The S content must be at least 0.005% for securing the foregoing effect. When it exceeds 0.050%, however, the toughness of steel is lowered. Thus, it is set in the range of 0.005 to 0.050%. The Ni content must be at least 0.05 for lowering the decarburizability of steel. However, even if Ni is added in an amount exceeding 0.30%, the effect has already been saturated and any further advantageous improvement, which reflects such excess addition, cannot be obtained in the effect. Rather, such excess addition will unfavorably lead to increased production cost. Thus, the Ni content is set in the range of 0.05 to 0.30%. The Cu content must be at least 0.05 for securing the foregoing effect. When it exceeds 1.00%, however, the hot workability of steel is lowered. Thus, it is set in the range of 0.05 to 1.00%. With respect to these three elements, when Cu does not exist alone but coexists with 0.005 to 0.050% of S or with 0.005 to 0.50% of S and 0.05 to 0.30% of Ni, decarburization can be considerably reduced.

A description will now be made of the reasons for specifying the contents of Cr, Mo, V, Nb and B as components which improve the properties of a spring when added in combination with the foregoing elements.

Cr: Cr is an element which is effective in enhancing the strength of steel. When the Cr content is lower than 0.20%, the foregoing effect cannot satisfactorily be expected. When it exceeds 1.50%, the toughness of steel deteriorates. Thus, it is set in the range of 0.02 to 1.50%.

Mo: Mo is an element which ensures a hardenability of steel and enhances the strength and toughness of steel. When the Mo content is lower than 0.05%, the foregoing effects cannot satisfactory be expected. When it exceeds 1.00%, coarse carbide grains are liable to precipitate to deteriorate the properties of the resulting spring. Thus, it is set in the range of 0.05 to 1.00%.

V: V is an element which enhances the strength of steel. When the V content is lower than 0.01%, the foregoing effect cannot satisfactorily be expected. When it exceeds 0.50%, the amount of carbide undissolved in austenite is increased to deteriorate the properties of the resulting spring. Thus, it is set in the range of 0.01 to 0.50%.

Nb: Nb is an element which makes crystal grains fine and makes fine carbide grains precipitate to enhance the strength and toughness of steel. When the Nb content is lower than 0.01%, the foregoing effect cannot satisfactorily be expected. On the other hand, when it exceeds 0.30%, the amount of carbide undissolved in austenite is increased to deteriorate the properties of the resulting spring. Thus, it is set in the range of 0.01 to 0.30%.

B: B is an element which improves the hardenability of steel. When the B content is lower than 0.0005%, the foregoing effect cannot satisfactorily be expected. On the other hand, when it exceeds 0.0050%, the foregoing effect is saturated. Thus, it is set in the range of 0.0005 to 0.0050%.

EXAMPLES

Steel samples having respective compositions as shown in Tables 1 and 2 were kept at 900° C. for 30 minutes, quench-hardened, and then tempered at 455° C. for one hour to measure the depth of the resulting decarburized ferrite layer and the depth of the resulting entire decarburized layer according to a JIS microscopic method. The results are shown in Tables 3 and 4.

TABLE 1

| Sample | Chemical Component (wt. %) | | | | | | | | | | | | |
|---|---|---|---|---|---|---|---|---|---|---|---|---|---|
| No. | C | Si | Mn | Al | S | Ni | Cu | Cr | Mo | V | Nb | B | Fe |
| 1 | 0.60 | 2.00 | 0.90 | 0.007 | 0.007 | 0.08 | — | — | — | — | — | — | balance |
| 2 | 0.58 | 2.45 | 0.86 | 0.028 | 0.030 | — | 0.06 | — | — | — | — | — | balance |
| 3 | 0.68 | 0.16 | 0.43 | 0.025 | 0.048 | 0.26 | 0.95 | — | — | — | — | — | balance |
| 4 | 0.62 | 2.03 | 0.88 | 0.018 | 0.006 | 0.05 | 0.05 | — | — | — | — | — | balance |
| 5 | 0.57 | 0.22 | 0.83 | 0.023 | 0.005 | — | 0.07 | 0.82 | — | — | — | — | balance |
| 6 | 0.51 | 0.25 | 0.84 | 0.024 | 0.007 | 0.06 | — | 0.91 | — | 0.18 | — | — | balance |
| 7 | 0.61 | 0.27 | 0.95 | 0.027 | 0.014 | 0.12 | 0.15 | 0.98 | — | — | — | 0.0010 | balance |
| 8 | 0.52 | 1.45 | 0.77 | 0.028 | 0.018 | 0.14 | 0.09 | 0.77 | — | — | — | — | balance |
| 9 | 0.58 | 0.23 | 0.98 | 0.031 | 0.010 | 0.1 1 | 0.09 | 0.84 | 0.30 | — | — | — | balance |
| 10 | 0.51 | 0.22 | 0.78 | 0.026 | 0.011 | 0.05 | 0.08 | 0.96 | — | 0.15 | 0.048 | — | balance |
| 11 | 0.56 | 1.52 | 0.45 | 0.020 | 0.006 | 0.06 | 0.07 | 0.81 | 0.10 | 0.20 | 0.028 | — | balance |
| 12 | 0.68 | 2.43 | 1.17 | 0.029 | 0.047 | 0.06 | 0.10 | 0.23 | 0.07 | 0.03 | 0.255 | — | balance |
| 13 | 0.55 | 0.17 | 0.82 | 0.098 | 0.007 | 0.10 | 0.09 | 1.45 | — | — | — | 0.0045 | balance |
| 14 | 0.56 | 1.52 | 0.42 | 0.020 | 0.009 | 0.08 | 0.09 | 0.90 | 0.95 | — | — | — | balance |
| 15 | 0.57 | 1.58 | 0.45 | 0.006 | 0.008 | 0.06 | 0.98 | 0.78 | 0.05 | 0.47 | — | — | balance |
| 16 | 0.61 | 2.05 | 0.92 | 0.023 | 0.002 | 0.08 | 0.07 | — | — | — | — | — | balance |
| 17 | 0.59 | 2.23 | 0.88 | 0.018 | 0.010 | 0.03 | 0.02 | — | — | — | — | — | balance |
| 18 | 0.63 | 2.17 | 0.91 | 0.027 | 0.001 | 0.09 | — | — | — | — | — | — | balance |
| 19 | 0.59 | 2.08 | 0.85 | 0.021 | 0.002 | — | 0.10 | — | — | — | — | — | balance |

TABLE 2

| Sample | Chemical Component (wt. %) | | | | | | | | | | | | |
|---|---|---|---|---|---|---|---|---|---|---|---|---|---|
| No. | C | Si | Mn | Al | S | Ni | Cu | Cr | Mo | V | Nb | B | Fe |
| 20 | 0.56 | 2.20 | 0.87 | 0.013 | 0.004 | 0.02 | 0.02 | — | — | — | — | — | balance |
| 21 | 0.56 | 1.51 | 0.47 | 0.032 | 0.002 | 0.03 | 0.02 | 0.82 | 0.10 | 0.19 | 0.024 | — | balance |
| 22 | 0.53 | 1.52 | 0.77 | 0.029 | 0.003 | 0.08 | — | 0.96 | 0.11 | 0.21 | 0.030 | — | balance |
| 23 | 0.55 | 1.58 | 0.45 | 0.020 | 0.002 | — | 0.09 | 0.85 | 0.10 | 0.20 | 0.028 | — | balance |
| 24 | 0.52 | 0.28 | 0.90 | 0.031 | 0.001 | 0.10 | 0.15 | 1.04 | — | 0.19 | 0.043 | — | balance |
| 25 | 0.54 | 1.49 | 0.73 | 0.035 | 0.007 | 0.04 | 0.03 | 0.97 | 0.11 | 0.20 | 0.034 | 0.0023 | balance |

Note: Sample Nos. 1–15: Examples of Present Invention
Sample Nos. 16–25: Comparative Examples

TABLE 3

| Sample No. | Depth of Decarburized Ferrite Layer (mm) | Depth of Whole Decarburized Layer (mm) | Note |
|---|---|---|---|
| 1 | 0 | 0.03 | Examples of Present Invention |
| 2 | 0 | 0.03 | |
| 3 | 0 | 0.00 | |
| 4 | 0 | 0.03 | |
| 5 | 0 | 0.02 | |
| 6 | 0 | 0.02 | |
| 7 | 0 | 0.00 | |
| 8 | 0 | 0.01 | |
| 9 | 0 | 0.00 | |
| 10 | 0 | 0.01 | |
| 11 | 0 | 0.02 | |
| 12 | 0 | 0.02 | |
| 13 | 0 | 0.01 | |
| 14 | 0 | 0.01 | |
| 15 | 0 | 0.00 | |
| 16 | 0.03 | 0.07 | Comparative Examples |
| 17 | 0.02 | 0.06 | |
| 18 | 0.04 | 0.08 | |
| 19 | 0.04 | 0.08 | |

TABLE 4

| Sample No. | Depth of Decarburized Ferrite Layer (mm) | Depth of Whole Decarburized Layer (mm) | Note |
|---|---|---|---|
| 20 | 0.04 | 0.09 | Comparative Examples |
| 21 | 0.04 | 0.07 | |
| 22 | 0.03 | 0.05 | |
| 23 | 0.04 | 0.07 | |
| 24 | 0.01 | 0.04 | |
| 25 | 0.01 | 0.04 | |

The results shown in Tables 3 and 4 demonstrate that decarburization of ferrite in steel did not occur in any of the Examples of the present invention, whereas decarburization of ferrite in steel occurred in the Comparative Examples, and that the depth of the entire decarburized layer in steel was smaller in the Examples of the present invention than in the Comparative Examples.

It is also demonstrated that the steel samples of the Examples of the present invention wherein components were controlled in the range of the composition specified in the claims, particularly with the addition of S and Ni, S and Cu, or S, Ni and Cu in combination, could very effectively prevent decarburization of the ferrite and is decrease the depth of the entire decarburized layer.

The spring steel of the present invention can be remarkably lowered in decarburizability during hot working and heat treatment thereof without the need of any decarburization-proofing agents and any specific heat treatment equipment. Accordingly, it has a very excellent effect that the decarburization thereof can be remarkably decreased with a low cost when it is applied to a coil spring, a flat spring or a torsion bar.

What is claimed is:

1. A lowly decarburizable spring steel consisting of, on a weight basis, 0.51 to 0.70% of C, 0.15 to 2.50% of Si, 0.40 to 1.20% of Mn, 0.005 to 0.100% of Al, 0.005 to 0.050% of S, at least one of 0.05 to 0.30% of Ni and 0.05 to 1.00% of Cu, and the balance being Fe and unavoidable impurities.

2. A lowly decarburizable spring steel consisting of, on a weight basis, 0.51 to 0.70% of C, 0.15 to 2.50% of Si, 0.40 to 1.20% of Mn, 0.005 to 0.100% of Al, 0.005 to 0.050% of S, at least one of 0.20 to 1.50% of Cr, 0.05 to 1.00% of Mo, 0.01 to 0.50% of V, 0.010 to 0.300% of Nb and 0.0005 to 0.0050% of B, at least one of 0.05 to 0.30% of Ni and 0.05 to 1.00% of Cu, and the balance being Fe and unavoidable impurities.

3. The spring steel of claim 1, wherein 0.05 to 0.30% of Ni is contained therein.

4. The spring steel of claim 1, wherein 0.05 to 1.00% of Cu is contained therein.

5. The spring steel of claim 1, wherein 0.05 to 0.30% of Ni and 0.05 to 1.00% of Cu are contained therein.

6. The spring steel of claim 2, wherein 0.05 to 0.30% of Ni is contained therein.

7. The spring steel of claim 2, wherein 0.05 to 1.00% of Cu is contained therein.

8. The spring steel of claim 2, wherein 0.05 to 0.30% of Ni and 0.05 to 1.00% of Cu are contained therein.

9. The spring steel of claim 2, wherein 0.20 to 1.50% of Cr is contained therein.

10. The spring steel of claim 2, wherein 0.05 to 1.00% of Mo is contained therein.

11. The spring steel of claim 2, wherein 0.01 to 0.50% of V is contained therein.

12. The spring steel of claim 2, wherein 0.010 to 0.300% of Nb is contained therein.

13. The spring steel of claim 2, wherein 0.0005 to 0.0050% of B is contained therein.

14. The spring steel of claim 2, wherein at least two of 0.20 to 1.50% of Cr, 0.05 to 1.00% of Mo, 0.01 to 0.50% of V, 0.010 to 0.300% of Nb and 0.0005 to 0.0050% of B are contained therein.

15. The spring steel of claim 2, wherein at three of 0.20 to 1.50% of Cr, 0.05 to 1.00% of Mo, 0.01 to 0.50% of V, 0.010 to 0.300% of Nb and 0.0005 to 0.0050% of B are contained therein.

16. The spring steel of claim 2, wherein at least four of 0.20 to 1.50% of Cr, 0.05 to 1.00% of Mo, 0.01 to 0.50% of V, 0.010 to 0.300% of Nb and 0.0005 to 0.0050% of B are contained therein.

17. The spring steel of claim 2, wherein 0.20 to 1.50% of Cr, 0.05 to 1.00% of Mo, 0.01 to 0.50% of V, 0.010 to 0.300% of Nb and 0.0005 to 0.0050% of B are contained therein.

* * * * *